US005201271A

United States Patent [19]

Pierre

[11] Patent Number: 5,201,271

[45] Date of Patent: Apr. 13, 1993

[54] INKING DEVICE FOR A ROTARY OFFSET PRINTING MACHINE

[75] Inventor: Simon Pierre, Orleans, France

[73] Assignee: Komori-Chambon, La Source, France

[21] Appl. No.: 857,736

[22] Filed: Mar. 26, 1992

[30] Foreign Application Priority Data

Feb. 11, 1991 [FR] France ..... 91 01545

[51] Int. Cl.[5] ..... B41F 31/06; B41F 31/14; B41F 31/30

[52] U.S. Cl. ..... 101/350; 101/DIG. 32

[58] Field of Search ..... 101/350, 352, 351, 148, 101/363, 207-210, DIG. 32; 118/258, 259, 263

[56] References Cited

U.S. PATENT DOCUMENTS 4,361,090 11/1982 Kungler et al. ..... 101/352
4,367,678 1/1983 Fischer ..... 101/350

FOREIGN PATENT DOCUMENTS 0036103 2/1981 European Pat. Off. .
116176 12/1983 European Pat. Off. ..... 101/349
2703425 3/1978 Fed. Rep. of Germany .
2467695 4/1981 France .
2467696 4/1981 France .

*Primary Examiner*—J. Reed Fisher
*Attorney, Agent, or Firm*—McAulay, Fisher, Nissen, Goldberg & Kiel

[57] ABSTRACT

The present invention relates to an inking device for a rotary offset printing machine.

This device is characterized in that the inking table is driven in rotation in the same direction as the ink fountain roller and in that an even number, equal to at least two, of intermediate transfer rollers are mounted on at least one mobile support and may be displaced between an inactive position and an active position in which one of the intermediate transfer rollers is in contact with the ink fountain roller, the other intermediate roller is in contact with the taker roller itself permanently maintained tangential to the inking table and the two intermediate transfer rollers are tangential to each other.

10 Claims, 1 Drawing Sheet

INKING DEVICE FOR A ROTARY OFFSET PRINTING MACHINE

FIELD OF THE INVENTION

The present invention relates to an inking device for a rotary offset printing apparatus.

BACKGROUND OF THE INVENTION

Rotary offset printing apparatus comprise an inking device designed to distribute as regularly as possible a film of ink on the peripheral surface of an inking roller itself in contact with a plate cylinder. Heretofore known inking devices generally comprise an ink fountain containing a mass of ink and a succession of horizontal rollers of parallel axes, to transfer the film of ink from the ink fountain to the surface of the inking roller. These rollers comprise, from upstream to downstream, firstly an ink fountain roller driven in rotation at low peripheral speed, this ink fountain roller defining, on one side, the ink fountain. The ink fountain roller takes along on its periphery a film of ink whose thickness is adjustable and is fixed by the position of a doctor blade disposed in the immediate vicinity of the peripheral surface of the ink fountain roller, in the lower part of the descending movement of the generatrices of this roller. The film of ink taken from the surface of the ink fountain roller is then transferred to the surface of a first roller, also called inking table, of a succession of rollers tangential to one another and finally depositing the film of ink on the periphery of the inking roller. The film of ink is generally transferred between the ink fountain roller and the inking table by means of a taker roller which is disposed between the ink fountain roller and the inking table. This taker roller is mounted idly on an oscillating support so as to be sometimes tangential to the ink fountain roller, in order to take the film of ink from the surface thereof, sometimes tangential to the inking table in order to deposit the film of ink thus taken on the surface of this inking table.

Among the inking devices of the type set forth hereinabove, certain are known which comprise an additional transfer roller making the inking device operate, as desired, either in accordance with a conventional inking mode with taker roller animated by an alternative movement, or a pellicular inking mode in which the taker roller is permanently maintained in contact with the inking table and the additional transfer roller, which is normally spaced apart during the inking mode employing alternative taker roller and which is brought to a very short distance from the ink fountain roller and in contact with the taker roller. Consequently, the film of ink taken by the ink fountain roller is transferred, by the additional transfer roller, to the taker roller and from the latter, to the inking table. Such inking devices with two operational modes are described for example in Patents DE-B-2 703 424 and EP-A-0 035 735.

In the inking device according to Patent EP-A-035 735, due to the fact that, in the pellicular inking mode, the ink fountain-, additional transfer-, taker rollers and the inking table are tangential to one another in that succession, the inking table necessarily rotates in direction opposite the ink fountain roller since there exist therebetween two intermediate rollers, namely the additional transfer roller and the taker roller. Consequently, when the inking device operates in alternative ink taking mode, i.e. when the additional transfer roller is in inactive position, spaced apart from the ink fountain roller and the taker roller, and this taker roller oscillates so as to be alternately in contact with the ink fountain roller and the inking table, the taker roller alternately encounters, during each oscillation, the surface of the ink fountain roller, rotating in one direction at very low speed, and that of the inking table, rotating in opposite direction at greater speed. Consequently, during each oscillation, the idle taker roller which was driven in rotation at high speed upon its previous contact with the inking table, then comes into contact with the ink fountain roller which, since it rotates in the same direction as it, moves in opposite direction in the zone of contact at much lower peripheral speed. The taker roller is then braked until it stops, and is then returned in direction opposite the preceding one, before coming into contact again with the inking table where, there again, it undergoes a braking then a reversal of its direction of rotation. Such an operation obviously presents the drawback of being detrimental to the mechanical elements of the inking device and it is an essential object of the present invention to overcome this drawback.

SUMMARY OF THE INVENTION

To that end, this inking device for a rotary offset printing machine, comprising a succession of horizontal rollers of parallel axes to transfer a film of ink from an ink fountain, containing a mass of ink, up to the surface of an inking roller in contact with a plate cylinder, these rollers comprising, from upstream to downstream, an ink fountain roller driven in rotation, at a low peripheral speed v1, and defining, on the one hand, the ink fountain, a taker roller mounted idly on an alternately mobile support and an inking table, the taker roller being disposed between the ink fountain roller and the inking table so as to come alternately into contact with these two rollers when the inking device operates according to the alternative ink taking mode, is characterized in that the inking table is driven in rotation in the same direction as the ink fountain roller, and in that an even number, equal to at least two, of intermediate transfer rollers are mounted on at least one mobile support and may be displaced between an inactive position in which they are maintained spaced apart from the ink fountain roller and the taker roller, and an active position in which one of the intermediate transfer rollers is in contact with the ink fountain roller, the other intermediate roller is in contact with the taker roller itself permanently maintained tangential to the inking table and the two intermediate transfer rollers are tangential to each other in order to allow the inking apparatus to operate in the pellicular inking mode in which a film of ink is transmitted from the ink fountain roller to the inking table, by means of the two intermediate transfer rollers and the taker roller, tangential to one another.

The inking device according to the invention presents a number of advantages. In the first place, when the inking device functions with an alternative taking of ink, the taker roller, if it undergoes variations in speed, is never subjected to a reversal of its direction of rotation, which is favourable from the point of view of acceleration and shocks detrimental to the quality of printing.

Another interesting advantage of the inking device according to the invention is that it makes it possible to conserve the same adjustment of the ink fountain (distance of blade, speed of the ink fountain roller) in the two alternative ink taking and pellicular inking modes. In fact, the theoretical increase in the flow of ink due to the continuous contact of the ink taking, in the case of pellicular inking mode, is compensated by an increase in the number of rollers dividing the film of ink (even number of intermediate transfer rollers).

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
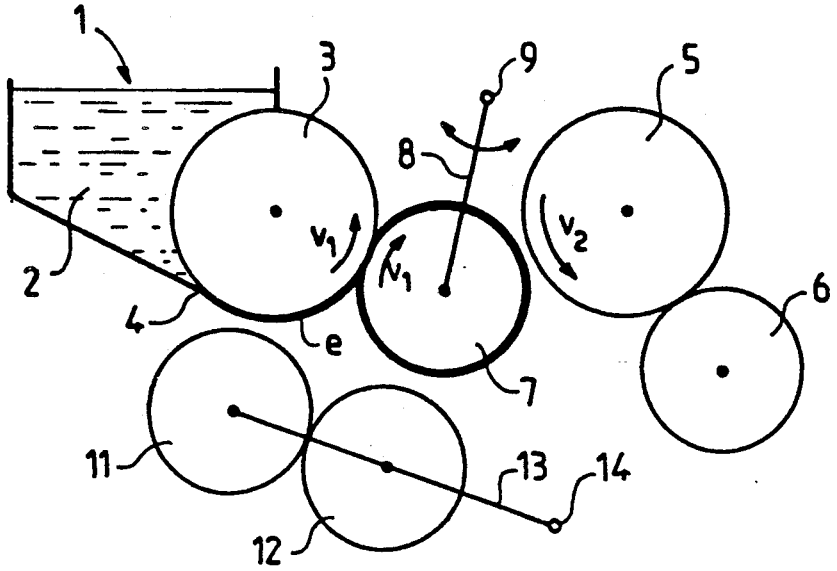
FIG. 1 is a schematic view in elevation of an inking device according to the invention, operating in accordance with the alternative taker roller mode, which taker roller is shown in contact with the ink fountain roller.
Figure 2:
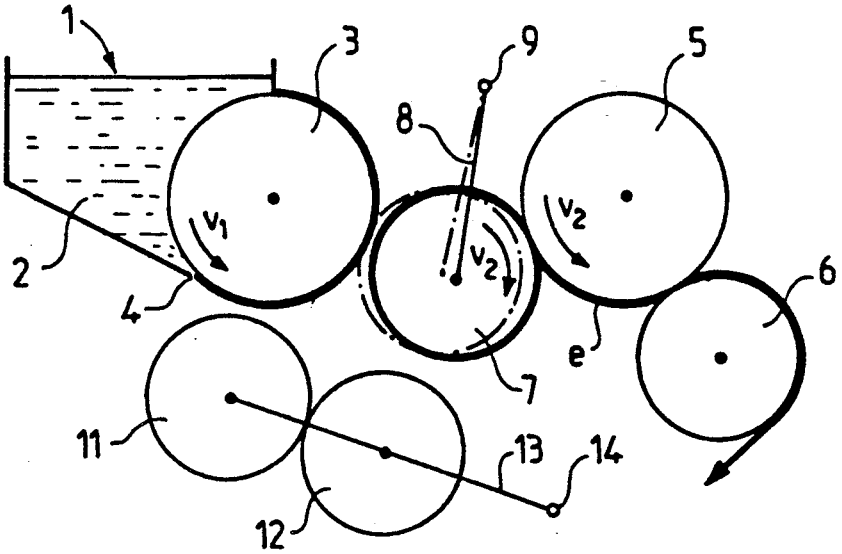
FIG. 2 is a schematic view in elevation of the inking device of FIG. 1, the taker roller being shown in contact with the inking table.
Figure 3:
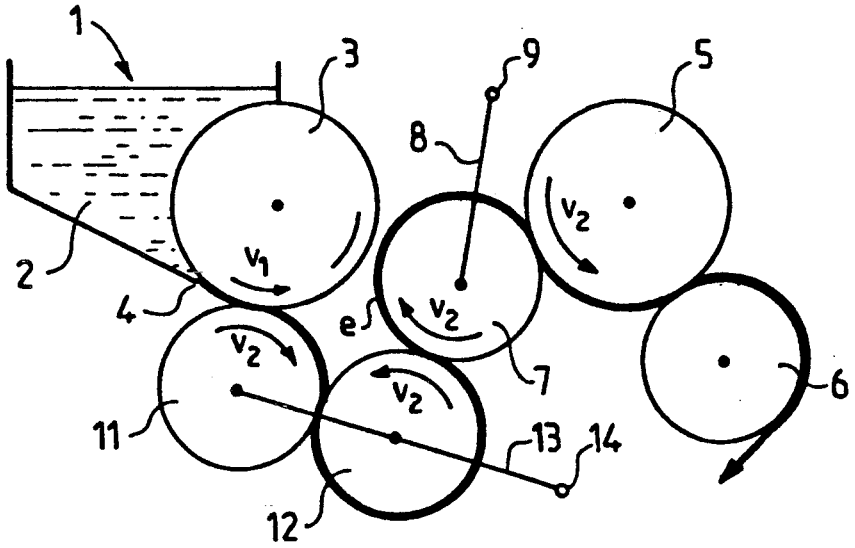
FIG. 3 is a schematic view in elevation of the inking device shown in FIG. 1 functioning in accordance with the pellicular inking mode.

Referring now to the drawings, the inking device according to the invention which is shown in FIGS. 1 to 3, is intended to distribute a film of ink over the peripheral surface of an inking roller (not shown) of an offset printing apparatus, from an ink fountain 1. This ink fountain 1 contains a mass of ink 2 which is retained in the ink fountain 1 by an ink fountain roller 3, of horizontal axis and rotating in anti-clockwise direction, at a low peripheral speed v1. The side of the ink fountain roller 3 where the generatrices move downwardly, faces the interior of the ink fountain 1 and in the lower part of this ink fountain 1 is disposed a doctor blade 4. The end of this doctor blade is located at a short distance from the peripheral surface of the ink fountain roller 3 in order to allow a film of ink e of predetermined thickness to pass over this surface. This film of ink must be transferred downstream, in the direction of the inking roller, by means of a first roller 5, also called inking table, and a succession of rollers tangential to one another, of which only the following roller 6 is shown. As shown in the drawing, the inking table 5 is driven in rotation in the same direction as the ink fountain roller 3, i.e. in anti-clockwise direction, but at a peripheral speed v2 clearly greater than the peripheral speed v1 of the ink fountain roller 3. Between the ink fountain roller 3 and the inking table 5 is disposed a taker roller 7 mounted idly on a support 8 which may oscillate about a horizontal pin 9 parallel to the axes of rollers 3 and 5. The support 8 and axis 9 are disposed so that the taker roller 7 can come into contact, sometimes with the ink fountain roller 3, sometimes with the inking table 5.

According to the invention, the inking device also comprises two additional intermediate transfer rollers 11 and 12 which are mounted on the same mobile support 13, being tangential to each other. This mobile support 13 may be mounted to pivot about a pin 14 parallel to the axes of rollers 3 and 5 so that, in an inactive position, the two intermediate transfer rollers 11, 12 are spaced apart from the ink fountain roller 3 and from the taker roller 7, as shown in FIGS. 1 and 2, or, in active position, these two rollers are respectively in contact with the ink fountain roller 3 and with the taker roller 7, itself then tangential to the inking table 5, as shown in FIG. 3.

The inking device according to the invention which has been described hereinabove may operate in accordance with two different modes, namely either an alternative ink taking mode or a continuous or pellicular ink taking mode.

FIGS. 1 and 2 illustrate the operation of the inking device in accordance with the alternative ink taking mode. In this case, the two intermediate transfer rollers 11, 12 are in inactive position, i.e. they are respectively spaced apart from the ink fountain roller 3 and from the taker roller 7, and the support 8 of this taker roller 7 is animated by a movement of oscillation about pin 9. Consequently, the taker roller 7 is brought alternately into contact with the ink fountain roller 3 (FIG. 1) and with the inking table 5 (FIG. 2). When it is in contact with the ink fountain roller 3 (FIG. 1), the taker roller 7 recovers, on its periphery, the ink forming the film e taken by ink fountain roller 3 from the ink fountain 1 and it is then driven in rotation, due to its contact with the ink fountain roller 3, at the low peripheral speed v1 of the latter, but in clockwise direction. At the moment when, during the movement of oscillation from left to right in FIGS. 1 and 2, the mobile support 8 applies the taker roller 7 against the inking table 5 (FIG. 2), this taker roller 7 has at that instant, in its zone of contact with the inking table 5, a peripheral speed v1 of the same direction as the peripheral speed v2 of the inking table 5, since the latter rotates in anti-clockwise direction. Furthermore, the peripheral speed v1 acquired by the taker roller 7, further to its contact with the ink fountain roller 3 rotating at this same speed, is less than the peripheral speed v2 of the inking table 5, in the zone of contact, so that the taker roller 7 is accelerated from speed v1 to speed v2 when it comes into contact with the inking table 5, without undergoing a reversal of its direction of rotation. During the movement of the support 8 in the opposite direction, i.e. from right to left in FIGS. 1 and 2, the taker roller 7 returns into contact with the ink fountain roller 3 and it is then braked, without reversal of its direction of rotation, its peripheral speed decreasing from v2 to v1. From the foregoing, it is therefore seen that, during the alternative ink taking mode, the taker roller 7 always rotates in the same direction, i.e. in clockwise direction, at a peripheral speed varying between v1 and v2.

When the inking device according to the invention is used in accordance with the pellicular inking mode, as shown in FIG. 3, the support 8 of the taker roller 7 is immobilized so that this taker roller 7 is always maintained in contact with the inking table 5. Furthermore, the mobile support 13 of the two intermediate transfer rollers 11, 12 is displaced so that they come into active position, in which they are respectively in contact with the lower parts of the ink fountain roller 3 and of the taker roller 7. In fact, the intermediate transfer roller 11 is maintained at a very short distance, of the order of a tenth of millimeter, from the peripheral surface of the ink fountain roller, whilst the other intermediate transfer roller 12 is applied against the peripheral surface of the taker roller 7. Consequently, the taker roller 7 tangential to the inking table 5, the intermediate transfer roller 12 tangential to the taker roller 7 and the other intermediate transfer roller 11 tangential to the first intermediate roller 12, all rotate at the same peripheral speed v2, as indicated by the arrows in FIG. 3. Consequently, there is a difference in the peripheral speeds v1 and v2 between the rollers 3 and 11 but this difference in speed is possible due to the small gap made between these two rollers 3 and 11. According to a variant, this small gap may be made between the two intermediate transfer rollers 11 and 12, the roller 11 then effectively being in contact with the lower part of the ink fountain roller 3. In that case, the roller 11 would rotate at the low speed v1 of the ink fountain roller, at a short distance from the other intermediate transfer roller 2 rotating at the higher speed v2 of the inking table 5.

From the foregoing, it is seen that the film of ink e formed in the lower part of the ink fountain roller 3 is continuously transferred to the peripheral surface of the inking table 5, firstly passing over the peripheral surface of the intermediate transfer roller 11 which is located at a very short distance from the lower part of the ink fountain roller 3. The film of ink is then transferred to the peripheral surface of the second intermediate transfer roller 12, tangential to the first 11 and rotating on its support 13 in anti-clockwise direction, at the peripheral speed v2. This second intermediate roller 12 in turn transfers the film of ink to the taker roller 7 which, itself, rotates in clockwise direction at the peripheral speed v2 equal to that of the inking table 5.

Although in the foregoing description it has been indicated that the two intermediate transfer rollers 11, 12 were mounted tangential to each other on the same support 13 oscillating about pin 14, it goes without saying that the device for assembling these rollers might be designed differently. In particular, the common support of the two rollers 11 and 12 might be mobile in another manner, for example in translation. Furthermore, according to another variant, the intermediate rollers 11 and 12 might be mounted on respective individual supports, being spaced apart normally from each other and being tangential to each other only when their respective supports have been displaced to bring them into the position relative to the pellicular inking shown in FIG. 3.

A number of intermediate transfer rollers, such as rollers 11, 12, greater than two may also be provided, on condition that this number be even in order to conserve the correct directions of rotation. In all embodiments of the invention, the intermediate transfer rollers such as rollers 11 and 12 may be mounted idly on their respective supports, i.e. they may rotate freely or they may be controlled, i.e. driven in rotation via a transmission mechanism.

What is claimed is:

1. An inking device for a rotary offset printing machine to transfer a film of ink from an ink fountain, containing a mass of ink, up to the surface of an inking roller in contact with a plate cylinder and operable in an alternative ink taking mode or in a continuous inking mode, comprising:

a succession of rollers, having parallel axes, form upstream to downstream, including an ink fountain roller driven in rotation, at a low peripheral speed v1, and being in ink receiving relationship with said ink fountain, a taker roller, a pair of transfer rollers, one of said transfer rollers forming an inking table and being juxtaposed to said taker roller for receiving ink therefrom, said taker roller being disposed between said ink fountain roller and said inking table, and final roller forming the other of said pair of transfer rollers tangential to said one transfer roller forming said inking table;

means mounting said taker roller on an alternately mobile support for moving said taker roller between said ink fountain roller and said one transfer roller for brining said taker roller alternately into contact with said ink fountain roller and said one transfer roller when the inking device operates in said alternative ink taking mode, and said one transfer roller and said ink fountain roller being driven for rotation in the same direction;

means including at least one pair of intermediate transfer rollers for operating said device in the continuous inking mode;

means mounting said at least one pair of intermediate transfer rollers on at least one mobile support displacing said at least one pair of intermediate transfer rollers between an inactive position in which they are maintained spaced part form said ink fountain roller and said take roller, and an active position in which one of said pair of intermediate transfer rollers is brought into contact with said ink fountain roller, and the other of said at least one pair of intermediate rollers is brought into contact with said taker roller, means for permanently maintaining said taker roller tangential to said one roller of said pair of intermediate transfer rollers and to said one transfer roller, said one pair of said intermediate transfer rollers being maintained tangential to each other in order for said inking device to operate in said continuous inking mode for transferring a film of ink transmitting from said ink fountain roller to said one transfer roller forming said inking table, by means of said two intermediate transfer rollers and said taker roller, said taker roller being tangential to one of said two intermediate transfer rollers and said intermediate transfer rollers being tangential to each other.

2. The device of claim 1, including a support, and means coupled with said support for moving said intermediate transfer rollers tangential to each other on said support.

3. The device of claim 1, including means mounting said intermediate transfer rollers to a pin for pivotal movement of said intermediate transfer rollers about said pin parallel to the axes of said succession of rollers.

4. The device of claim 2, wherein said support is a common support for said two intermediate transfer rollers and means mounting said two intermediate transfer rollers to said common support for translation mobility.

5. The device of claim 1, including a support for each of said intermediate transfer rollers and means idly mounting said intermediate transfer rollers on said support.

6. The device of claim 1, including means for driving and controlling said intermediate transfer rollers in rotation on their support.

7. The device of claim 1, including means for moving said intermediate rollers to an active position, to provide a small gap, of the order of a tenth of millimeter, between said ink fountain roller and said one of said intermediate transfer rollers of transferring a film of ink formed between said fountain roller and said one intermediate transfer roller for continuously transferring said film of ink from the other of said intermediate transfer rollers to solely said taker roller.

8. The device of claim 1, including means for moving said intermediate transfer rollers to an active position, to provide a small gap, of the order of a tenth of a millimeter, between said two intermediate transfer rollers.

9. The device of claim 1, wherein said ink fountain includes a doctor blade portion in contact with said ink fountain roller, said ink fountain roller and said doctor blade forming a portion retaining the ink in said ink fountain.

10. The device of claim 1, including means for moving said intermediate rollers to an active position, to provide a small gap, of the order of a tenth of a millimeter, between said ink fountain roller and said one of said intermediate transfer rollers.

* * * * *